US007475975B2

(12) United States Patent
Shimizu

(10) Patent No.: US 7,475,975 B2
(45) Date of Patent: Jan. 13, 2009

(54) INKJET PRINTHEAD ASSEMBLY

(75) Inventor: Yoichiro Shimizu, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 248 days.

(21) Appl. No.: 11/170,462

(22) Filed: Jun. 28, 2005

(65) Prior Publication Data

US 2006/0001718 A1 Jan. 5, 2006

(30) Foreign Application Priority Data

Jun. 30, 2004 (JP) ..... 2004-192882

(51) Int. Cl.
*B41J 2/175* (2006.01)

(52) U.S. Cl. ..... 347/93

(58) Field of Classification Search ..... 347/86, 347/87, 92, 93; 210/448, 459, 460
See application file for complete search history.

(56) References Cited

U.S. PATENT DOCUMENTS 4,864,329 A * 9/1989 Kneezel et al. ..... 347/93
5,141,596 A * 8/1992 Hawkins et al. ..... 216/2
5,742,314 A * 4/1998 Hayes ..... 347/93
6,267,251 B1 * 7/2001 Sullivan ..... 210/488
6,464,347 B2 * 10/2002 Kneezel et al. ..... 347/93

FOREIGN PATENT DOCUMENTS

JP 11277758 10/1999
JP A-2001-239677 9/2001

* cited by examiner

*Primary Examiner*—Anh T. N. Vo
(74) *Attorney, Agent, or Firm*—Reed Smith LLP

(57) ABSTRACT

An inkjet printhead assembly includes: a channel structure defining inside thereof an ink supply channel connected to an ink supply source accommodating ink; a filter member having a filtering area where a plurality of filter holes are formed through the thickness, and a fixing area having a plurality of recesses; a head unit having a port portion where an ink supply port for introducing the ink supplied from the ink supply source via the filter holes is formed so that the head unit ejects droplets of the ink; the fixing area of the filter member being located at an outer circumferential position with respect to the ink supply port; a first one of the channel structure and the port portion of the head unit being bonded with an adhesive to the filter member at the fixing area; and a part of the adhesive being accommodated in the recesses.

7 Claims, 7 Drawing Sheets

PRIOR ART

INKJET PRINTHEAD ASSEMBLY

INCORPORATION BY REFERENCE

The present application is based on Japanese Patent Application No. 2004-192882, filed on Jun. 30, 2004, the content of which is incorporated herein by reference.

BACKGROUND OF THE INVENTION

1. Field of the Invention

The invention relates to an inkjet printhead assembly.

2. Description of the Related Art

There is known an inkjet printhead assembly including a head unit and a planar piezoelectric actuator attached to the head unit. The head unit has an ink supply port connected via an ink supply channel to an ink supply source storing ink and receives the ink from the ink supply source. The head unit further has a plurality of pressure chambers formed in the head unit, and a large number of nozzles respectively communicated with the pressure chambers. When the ink in each pressure chamber is selectively pressurized, a droplet of the ink is ejected through the corresponding one of the nozzles.

To the ink supply port of the head unit is connected a channel structure of resin through which the ink supply channel extends so that the ink is supplied into the head unit from the ink supply source. A filter member for filtering out foreign materials such as dirt is attached to cover the ink supply port, since introduction of foreign materials into the ink supply port leads to clogging of the nozzles or other portions which causes failure in ejection of ink droplets.

Thus, at a portion where the ink supply port is disposed, the filter member and the resin channel structure are attached.

The filter member and the channel structure are typically connected by bonding or welding. The ink supply port is formed in a base plate of metal such as nickel alloy, and the filter member is typically of metal such as nickel alloy. To assemble the three members, namely, the filter member, the channel structure, and the base plate, the metallic filter member is bonded to the metal base plate, and the resin channel structure is bonded to the metallic filter member. The resin channel structure may be fixed to the filter member or the base plate by ultrasonic welding, not by bonding with adhesive.

Such a filter member has a large number of minute filter holes having a diameter smaller than that of the nozzles. Since the filter member functions as intended only when the diameter of the filter holes is sufficiently small, the diameter of the filter holes is limited, and a filtering area across which the filter holes are formed in the filter member is made accordingly large in order to compensate for the increase in the resistance of the filter holes to the ink flow due to the limited diameter of the filter holes. Thus, in the filter member, a great number of very small holes are formed over an area corresponding to each ink supply port.

As the filter member, there are known a mesh filter using cloth of fiber or thin wire where the small clearances between the fibers or wires serve as filter holes, as well as a filter of thin metal sheet having filter holes each in a circular shape, for instance. Such a metal filter is formed by etching or electroforming.

Etching and electroforming are preferable as a method for forming the metal filter, since these enable to reduce the thickness of the metal filter. Between the two methods, however, electroforming is more preferable, since electroforming enables to form the filter holes with higher precision in shape, compared with etching.

Meanwhile, there is already disclosed, for instance in Japanese Patent Application Laid-Open No. 2001-239677 (see pages 1-6 and FIG. 2), an inkjet printhead assembly including a filtering arrangement such that a filter member is placed in a recess and a clearance between the filter member and each of a channel structure and an inner wall of the recess is filled with an adhesive material.

In manufacture of such an inkjet printhead assembly, where the filter member and the channel structure are bonded to each other with an adhesive, the working process is relatively simple and involved operations are relatively easy. However, because of a change in temperature around the filtering arrangement or for other reasons, the bonding strength between the filter member and the channel structure may later deteriorate, and the filter member and the channel structure may be separated from each other. In addition, since the channel structure is an annular member having a relatively small thickness, the width of the annular area at which the channel structure is bonded to the filter member is relatively small, leading to an insufficient bonding strength therebetween. Thus, it is required to enhance the bonding strength.

On the other hand, the method in which the filter member is placed in the recess and the clearance is filled with the adhesive material requires, in manufacture of the inkjet printer, a step for forming the recess in a depth corresponding to the filter member as well as a step for filling the recess with the adhesive material. Hence, this method fails to shorten or simplify the manufacturing process.

SUMMARY OF THE INVENTION

The invention has been developed in view of the above-described situations, and it is an object of the invention to provide an inkjet printhead assembly which comprises: a head unit comprising a nozzle plate and an ink supply port; a filter member; and a channel structure having inside thereof an ink supply channel, and connected via the filter member to the ink supply port, the filter and the channel structure being bonded to each other with an enhanced bonding strength.

To attain the above object, the present invention provides an inkjet printhead assembly including a channel structure defining inside thereof an ink supply channel connected to an ink supply source accommodating ink, a filter member having a filtering area where a plurality of filter holes are formed through the thickness of the filter member and a fixing area having a plurality of recesses, and a head unit having a port portion where an ink supply port for introducing the ink supplied from the ink supply source via the filter holes is formed so that the head unit ejects droplets of the ink. The fixing area of the filter member is located at an outer circumferential position with respect to the ink supply port, and a first one of the channel structure and the port portion of the head unit is bonded with an adhesive to the filter member at the fixing area, while a part of the adhesive is accommodated in the recesses.

According to this arrangement, the one of the channel structure and the port portion is bonded to the filter member at the fixing area, with the adhesive entering the recesses formed in the fixing area, thereby improving the bonding strength.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 4A and 4B are enlarged views of a head unit of the inkjet printhead assembly, in which FIG. 4A shows a state where four filter members are attached to the head unit, and FIG. 4B shows a state where a channel member having a plurality of the channel structures is also attached;

DETAILED DESCRIPTION OF PREFERRED EMBODIMENTS

Figure 1A:
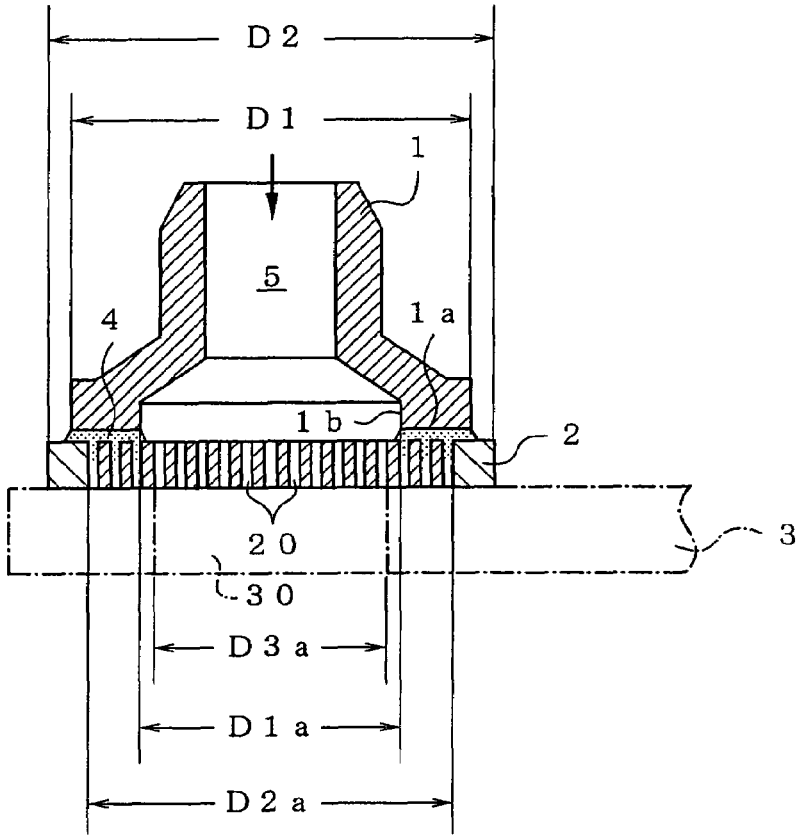
FIG. 1A is a schematic view showing a bonding structure between a channel structure and a filter member in an inkjet printhead assembly according to a first embodiment of the invention.

Hereinafter, there will be described presently preferred embodiments of the invention, by referring to the accompanying drawings.

Referring to FIGS. 1 to 6, there will be described an inkjet printhead assembly H according to a first embodiment of the invention. The printhead assembly H includes two head units 3 each comprising a nozzle plate in which a large number of nozzles are formed. Four circular filter members 2, and a channel member 10 comprising four generally cylindrical channel structures 1, are attached to each head unit 3 and partially constitute ink supply channels extending from an ink supply source in the form of ink cartridges 8A, 8B, 8C, 8D to the respective nozzle plates in order to supply inks in the ink cartridges 8A-8D to the nozzle plates.

Each of the head units 3 has a port portion in which four ink supply ports 30 are formed. The four filter members 2 are attached to the port portion in order to prevent introduction of foreign materials or dirt to the nozzles, which would otherwise lead to unsatisfactory ejection of ink droplets, or failure in ejection thereof. The channel member 10 is fixed to the port portion such that the channel member 10 and the port portion of the head unit 3 sandwich the filter members 2.

There will be described a general structure of the inkjet printhead assembly H, referring to FIGS. 4 to 6.

Figure 6:
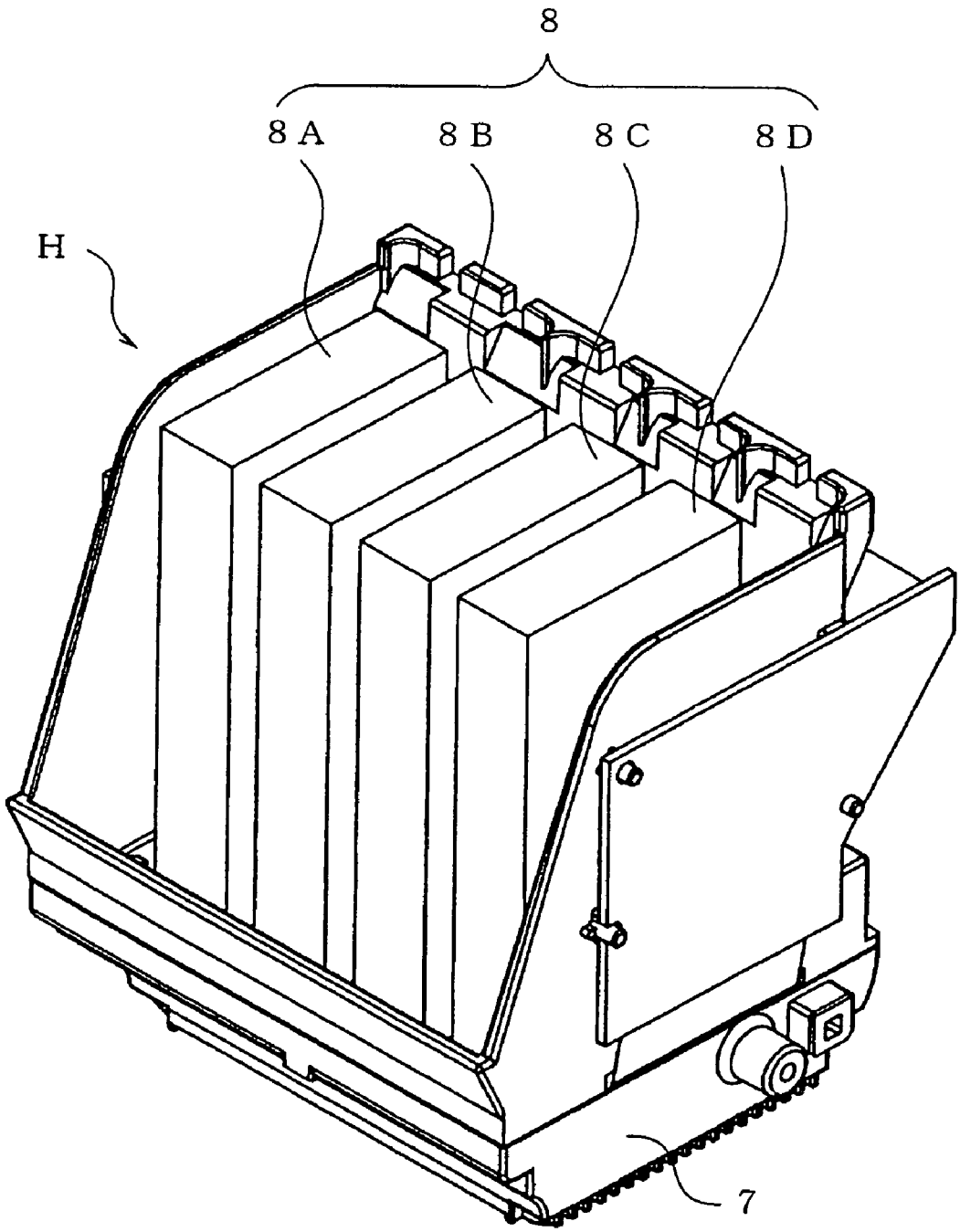
FIG. 6 is a perspective overall view showing the inkjet printhead assembly to which ink cartridges are mounted.

The inkjet printhead assembly H as shown in FIG. 6 is a component of an inkjet printer, and is supported by a carriage which is moved in a main scanning direction while a recording medium is fed in a sub scanning direction, to print image or the like on the recording medium. As shown in FIG. 6, main components of the inkjet printhead assembly H are the ink cartridges 8A, 8B, 8C, 8D storing inks of respective colors, the head holder 7 on which the ink cartridges 8A-8D are removably attached, and printheads (described later) attached at the bottom of the head holder 7, although not seen in FIG. 6. The inkjet printhead assembly H is mounted on the carriage to perform printing.

Figure 5:
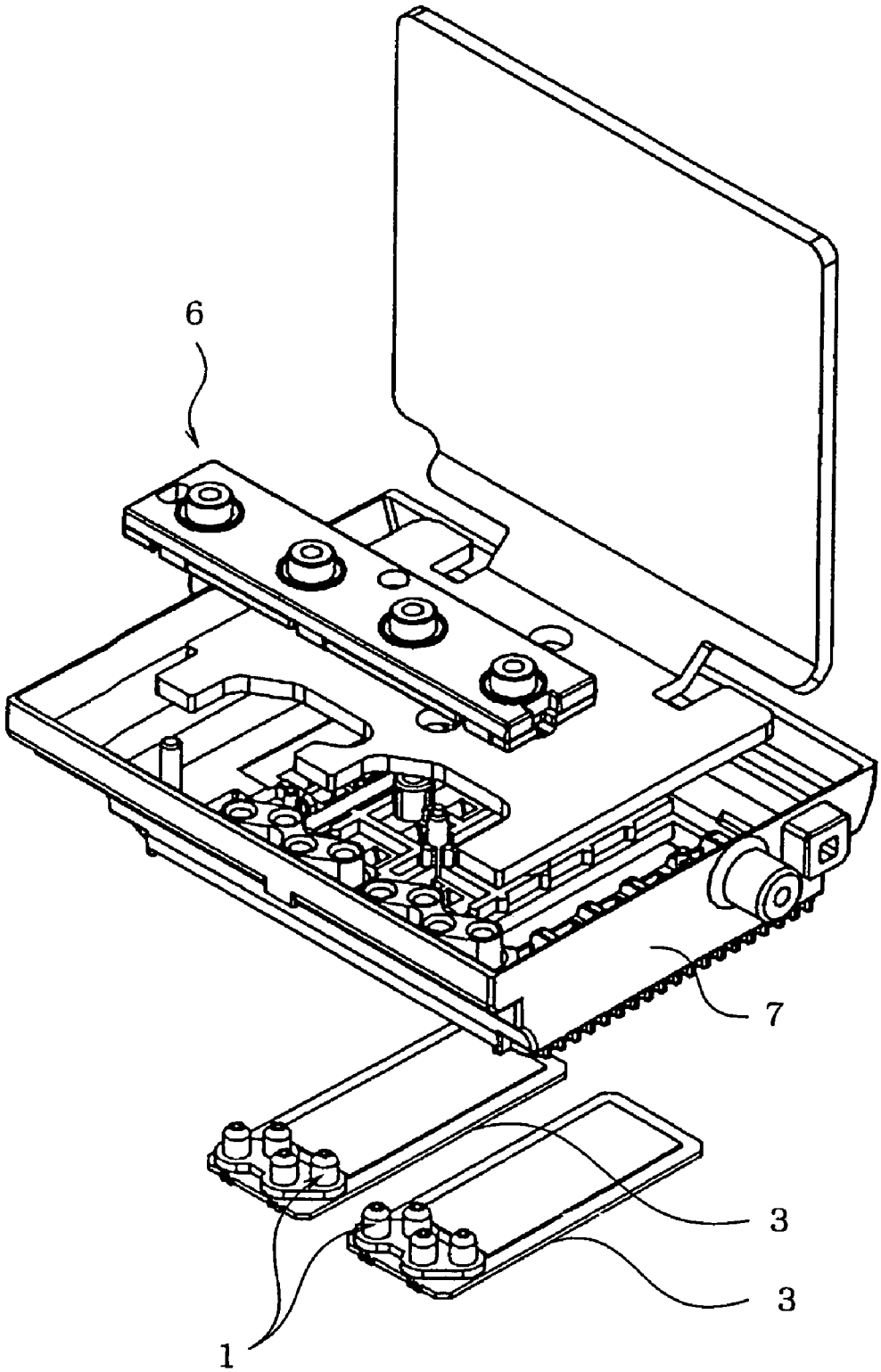
FIG. 5 is an exploded perspective view of the printhead assembly without ink cartridges.

FIG. 5 shows the inkjet printhead assembly H from which the ink cartridges 8 are removed. The printhead assembly H further comprises a joint member 6 connected to outlets of the respective ink cartridges 8. The head units 3 of the printheads are connected via the joint member 6 to the ink cartridges 8 to receive the inks therefrom. Each of the head units 3 comprises the nozzle plate. The structure of the head unit is well known in the art and not described here. The two printheads are attached to an undersurface of a bottom plate of the head holder 7, with the channel structures 1 of the channel member 10 attached to the head unit 3 to extend through the bottom plate of the head holder 7 to be connected to the joint member 6. Thus, the inks in the ink cartridges 8 are supplied to the nozzle plates via the joint member 6.

Figure 4A:
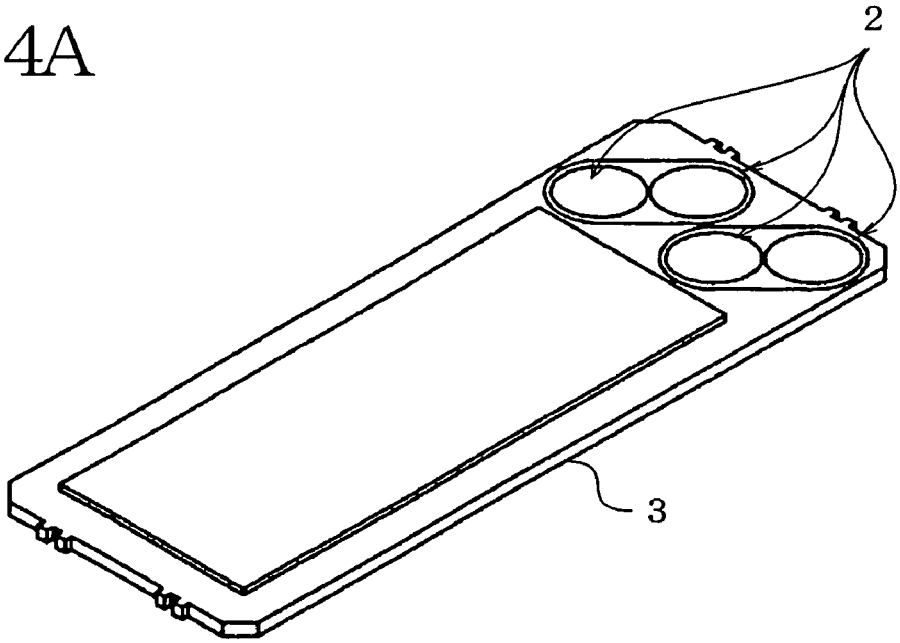
Figure 4B:
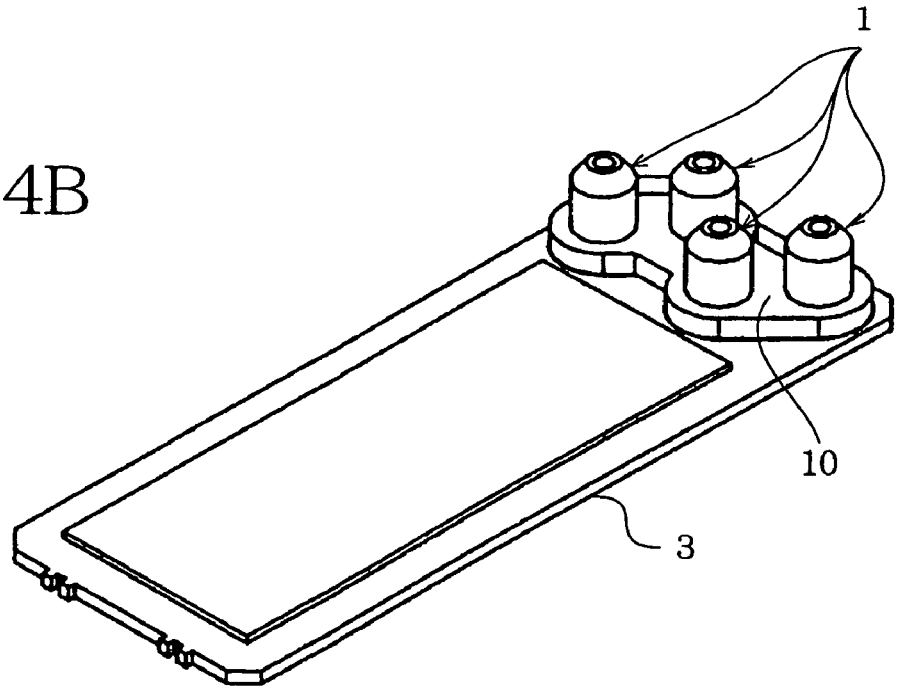

FIGS. 4A and 4B are enlarged perspective views of one of the two printheads. FIG. 4A shows a state where the filter members 2 are attached to the head unit 3, and FIG. 4B shows a state where the channel member 10 is also attached on the head unit 3.

As shown in FIG. 5, a single printhead is for ejecting droplets of two color inks. The head unit 3 of each printhead has four, or two pairs of, ink supply ports 30 for two of four inks having their own colors, as shown in FIG. 4A, so that each two of the four filter members 2 together provides a relatively wide total filtering area for a color ink, at which filtering is actually implemented.

Thus, two of four channel structures 1 of a single channel member 10 are connected to a single ink supply channel in the joint member 6. In other words, at each of four channel connections in the joint member 6, each ink supply channel bifurcates, although not shown in drawings. Two branches of each ink supply channel go through the respective filter members 2 to supply the ink into the corresponding two ink supply ports 30 of the head unit 3.

As described above, in the port portion of the head unit 3, four ink supply ports 30 are formed for two inks, that is, two ports 30 are formed for a single ink.

Thus, to supply the inks stored in the ink cartridges 8 to the nozzle plates of the head units 3, the respective outlets of the ink cartridges 8A, 8B, 8C, 8D are connected to the four ink supply channels of the joint member 6, the eight or four pairs of channel structures 1 of the two channel members 10 (four channel structures 1 of a single channel member 10 for each head unit 3), eight filter members 2 positioned corresponding to the eight channel structures 1, and the two head units 3, in the order of description. In this way, multiple continuous ink passages are formed to extend from the ink cartridges 8 to the respective nozzles formed in the nozzle plates. In the head units 3, the ink passages extend, continuing from the branches of the ink supply channels, namely, the ink passages enter the head units 3 through the ink supply ports 30 and terminate at the nozzles. Further details of the ink passages inside the head units are dispensed with.

Figure 1B:
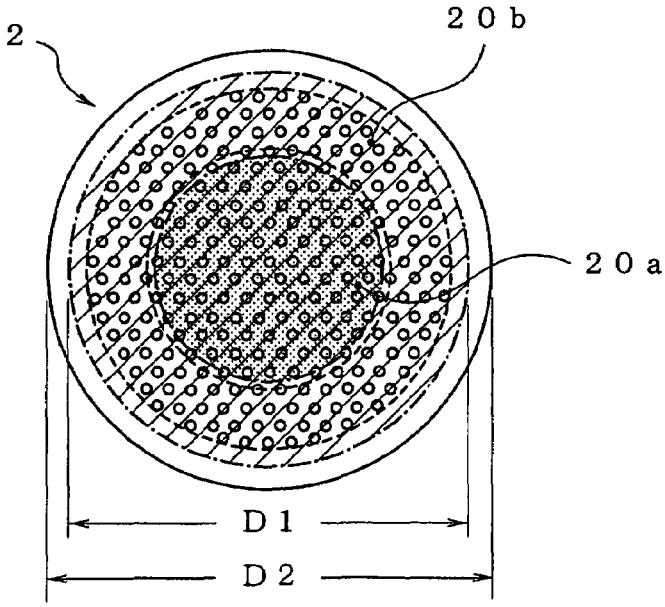
FIG. 1B is a plan view of the filter member.
Figure 2:
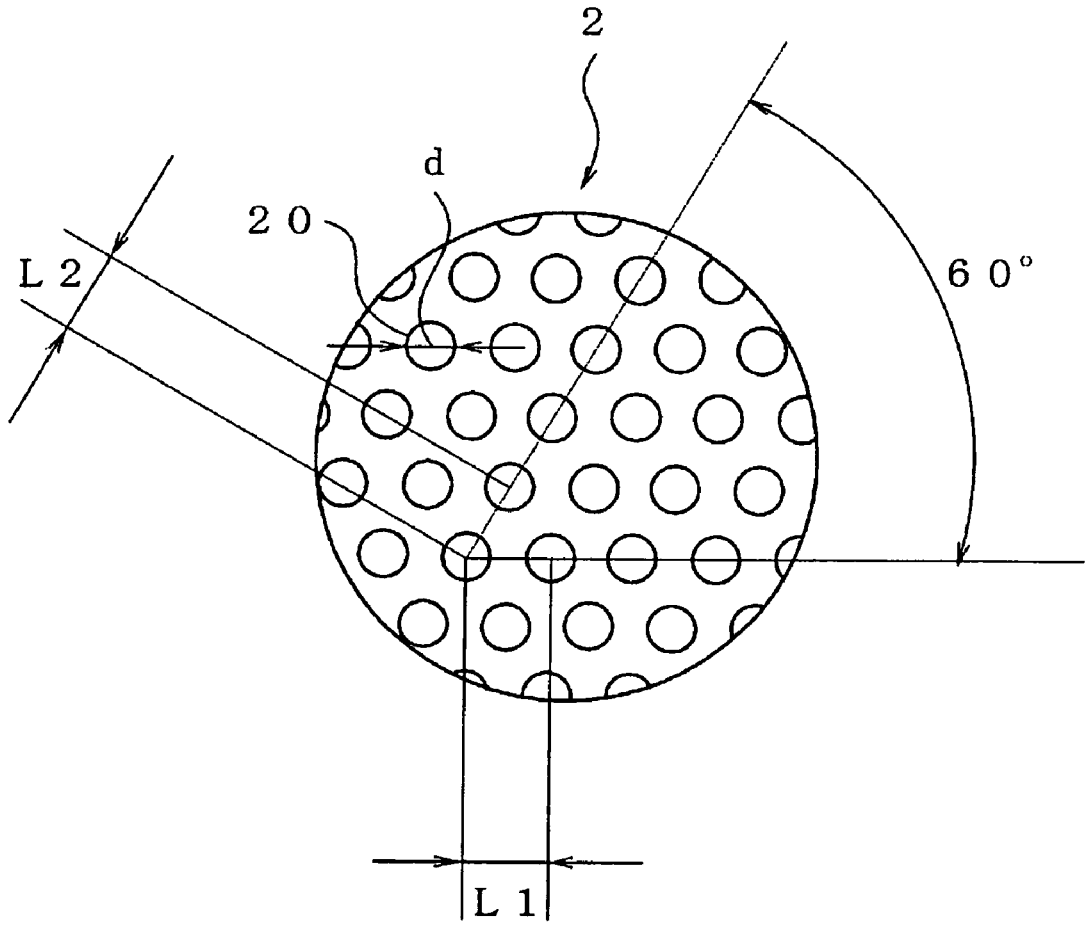
FIG. 2 shows in enlargement a part of the filter member.
Figure 3:
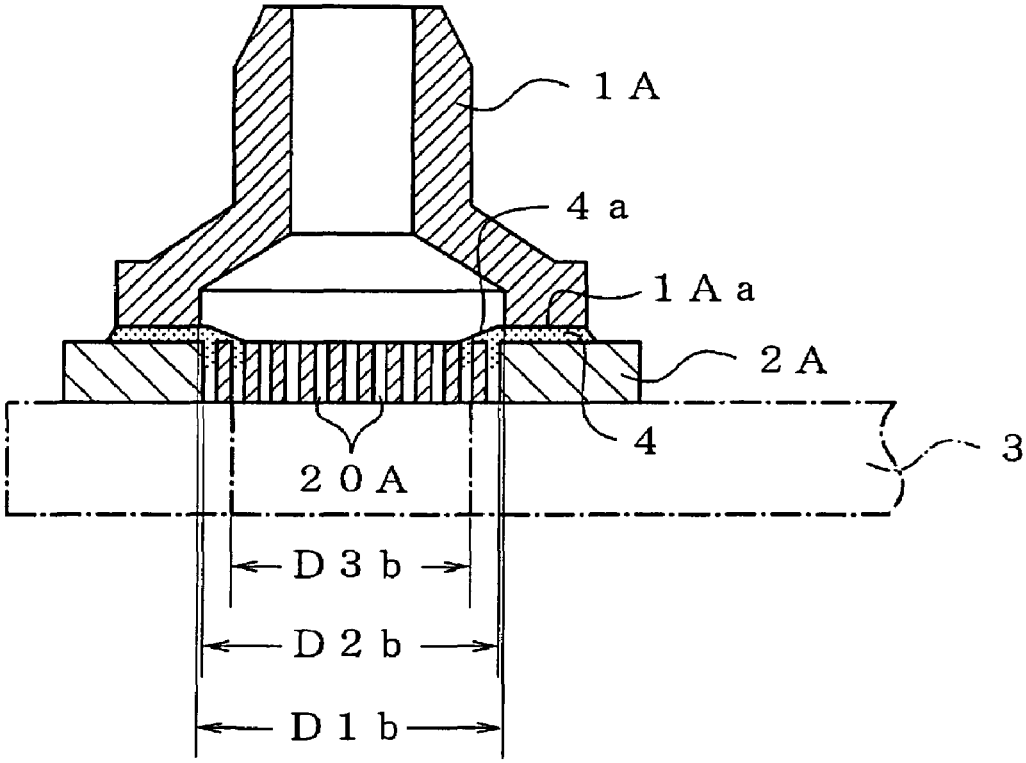
FIG. 3 is a schematic view showing a conventional bonding structure between a channel structure and a filter member.

There will be now described in detail how the channel member 10 and the filter members 2 are connected to each other, by referring to FIGS. 1 to 3. In these drawings, to facilitate understanding, the filter member 2 is drawn as having a considerable thickness although the filter member 2 is actually a thin sheet, and an adhesive is also exaggerated.

As shown in FIG. 1A, each channel member 10 is bonded with an adhesive 4 to the filter members 2 fixed to the port portion of the head unit 3. Comprising a laminate of a plurality of plates including a nozzle plate and an actuator plate on top thereof, the head unit 3 is one well known as a head unit for used in an inkjet printer. An upper surface, as seen in FIG. 1A, of the head unit 3 is formed of a metal material, e.g., stainless steel. The upper surface includes the port portion. In the description below, the indication of a direction is that as seen in FIG. 1.

As described above, the filter member 2 is a thin sheet to filter the ink and has a filtering area across which are formed a large number of small filter holes 20. The filter holes 20 desirably have a same shape and diameter capable of filtering out the foreign materials in the ink. In the present embodiment, the filter member 2 is formed of a sheet metal, such as that of nickel alloy, produced by electroforming, which enables formation of minute holes in a desired shape and diameter.

As the material forming the channel member 10 comprising the channel structures 1, resin is employed, since with resin it is easy to form a channel member 10 in a desired shape and light in weight. The resin channel member 10 is bonded to the metallic filter members 2. Conventionally it was difficult to bond a resin channel member to a metallic filter member 2 with a sufficient bonding strength. According to the present invention, however, a sufficient bonding strength is ensured even these resin and metallic members are bonded to each other, as later described in detail.

As shown in FIG. 4A, the head unit 3 has four ink supply ports 30 formed in the port portion thereof to which four filter members 2 and one channel member 10 are connected in turn. One of the ink supply ports 30 is shown in FIG. 1A. The ink supply port 30 has a circular upper open end whose diameter is D3*a*. From the ink supply source, namely, one of the ink cartridges 8, the ink is introduced into the channel structure 1 in a direction indicated by an arrow in FIG. 1A, and flows through the filter member 2 into the head unit 3 having the nozzle plate.

A lower end of the branch of the ink supply channel in the channel structure 1 is circular and has a diameter D1*a*, which is larger than the diameter D3*a* of the upper end of the ink supply port 30. Further, the outer diameter D2 of the filter member 2 is larger than, or substantially the same as, the outer diameter D1 of the channel structure 1. In the present embodiment, as shown in FIGS. 1A and 1B, the adhesive 4 present between the filter member 2 and the channel structure 1 is prevented from flowing onto the upper surface of the head unit 3, by the making the outer diameter D2 of the filter member 2 larger than that D1 of the channel structure 1 by a small amount. A fixing surface 1*a* of the channel structure 1 at which the channel structure 1 is bonded to the filter member 2 corresponds to the thickness of the channel structure 1, i.e., the annular bottom surface of the channel structure 1 around the lower end of the branch of the ink supply channel (hereinafter simply referred to as "the ink channel end"). In FIG. 1A, the width of the annular fixing surface 1*a* is defined between the circumference of the end of the ink supply channel and the external circumferential surface of the channel structure 1 at the bottom of the channel structure 1.

According to this arrangement where the channel structure 1 has the diameter not increasing the resistance to the ink flow into the ink supply port, and the outer diameter of the filter member to which the channel structure is bonded is larger than that of the channel structure, the channel structure can be bonded with reliability.

The filter holes 20 of the filter member 2 are formed across a circular area having a diameter D2*a* larger than the diameter D1*a* of the ink channel end, that is, the filter holes 20 are formed across the area extending beyond the area of the ink channel end.

As shown in FIG. 1B, the filter member 2 has a fixing area 20*b* around a filtering area 20*a* which corresponds to the area of the upper end of the ink supply port 30. The fixing area 20*b* is an annular area at which the channel structure 1 is bonded to the filter member 2, and is opposed to the fixing surface 1*a* of the channel structure 1. The filter holes 20 are formed in the fixing area 20*b* also, and the filter member 2 and the channel structure 1 are bonded to the port portion at an area corresponding to the fixing area 20*b*, such that a part of the adhesive 4 is accommodated in the filter holes 20 in the fixing area 20*b*.

That is, in this embodiment, the filter holes 20 are formed across a circular area extending beyond a radial position corresponding to the inner circumference of the fixing surface 1*a* and up to a substantially middle position in the width direction of the annular fixing area 20*b*. Whether formed in the filtering area 20*a* or in the fixing area 20*b*, the filter holes 20 are all identical, having a same shape and diameter, and arranged at same intervals. In an outer peripheral portion of the fixing area 20*b*, no filter holes are formed, contributing to ensure a rigidity of the filter member 2 as a whole.

According to this arrangement where the filter holes are formed in the fixing area also, the filter holes in the fixing area function as holes for enhancing the bonding strength between the filter member and the channel structure.

The conventional mesh filter, whose filter holes are provided by the small clearances between fibers or thin wires, warps at its peripheral portion and lacks for a rigidity as a whole. Thus, it is difficult to attach the conventional mesh filter to the surface of the port portion and the channel structure, in close contact therewith.

Since there are formed many filter holes 20 in a portion of the fixing area 20*b* on the side of the filtering area 20*a* (which may be referred to as "a radially internal portion"), a surplus of the adhesive 4 applied on the fixing surface 1*a* enters the filter holes 20 formed in the radially internal portion, and does not narrow the filtering area 20*a*.

Such a filter member 2 may be formed by etching such that a resist in a pattern corresponding to the filter holes 20 is formed on a metal sheet to be the filter member 20, and throughholes are formed using a solvent. Alternatively, electroforming may be employed as a method for forming the filter member 2.

The channel structure 1 is of resin, and thus can be welded to the metallic filter member 2. Where bonding with an adhesive is employed, however, it is enabled to bond the channel structure 1 to another member made of any material, facilitating the bonding operation.

The channel structure 1 is bonded to the filter member 2 with a part of the filter holes 20 located under the fixing surface 1*a* of the channel structure 1. Hence, the adhesive 4 applied on the fixing surface 1*a* enters the filter holes 20 formed in the fixing area 20*b* and solidifies there, enhancing the bonding strength between the channel structure 1 and the filter member 2.

In this embodiment, a thermosetting adhesive is used as the adhesive 4, since a thermosetting adhesive exhibits a flowability and enters the filter holes 20 when heated to some degree, but is hardened when heated up to a certain value. Therefore, by applying the thermosetting adhesive 4 on the fixing surface 1*a* of the channel structure 1, and then gradually heat-curing the adhesive 4 while pressing the channel structure 1 onto the filter member 2 which is to be bonded to the surface of the port portion around the ink supply port 30, a part of the adhesive 4 at least enters the filter holes 20 in the fixing area 20*b*, that is, the adhesive reaches or does not reach the bottom of the filter holes 20, or the surface of the port portion in the head unit 3. With a part of the adhesive 4 in the filter holes 20 in such a way, the adhesive 4 is hardened.

According to this arrangement where upon the heat curing of the adhesive a part of the adhesive is in the filter holes which are formed in the fixing area for aiding bonding, the bonding strength is enhanced.

Even when the adhesive 4 stops at an upper position in each filter hole 20, as shown in FIG. 1A, an anchoring effect of the adhesive 4 that the channel structure 1 and the filter member 2 are bonded with an enhanced bonding strength of the adhesive 4 is expectable.

In the process of bonding the channel structure 1, how deeply the adhesive 4 applied on the fixing surface 1*a* enters the filter holes 20 depends on the amount and flowability of the adhesive 4 as applied on the fixing surface 1*a*, the thickness of the filter member 2, the aspect ratio of the filter holes 20, and others.

For instance, the thickness of the filter member 2 is reduced, and the diameter of the filter holes 20 is made larger than this thickness, so that the adhesive 4 enters the filter holes 20 throughout the depth thereof, in order that the adhesive 4 connects the channel structure 1 and the port portion of the head unit 3, through the filter member 2. In this way, the adhesive 4 functions to directly bond the channel structure 1 to the port portion. According to this embodiment, the three members, namely, the channel structure 1, the filter member 2, and the port portion are bonded to one another with a high bonding strength.

In this arrangement, all the filter holes are formed at a time in the same way, and the filter holes in the fixing area are utilized as holes for aiding bonding.

As described above, a part of the filter holes 20 are formed in a radially inner portion of the fixing area 20*b*, which is defined between a position corresponding to an inner circumference 1*b* of the fixing surface 1*a* and a middle position in the width of the annular fixing surface 1*a*, or a position on the outer side of the middle position. However, electroforming using a suitably prepared die may be employed as a method for producing the filter member 2. When such electroforming is employed, increasing the number of the filter holes 20 does not push up the cost of the filter member 2, and it is allowed to form the filter holes 20 across an entirety of the filter member 2.

Figure 7A:
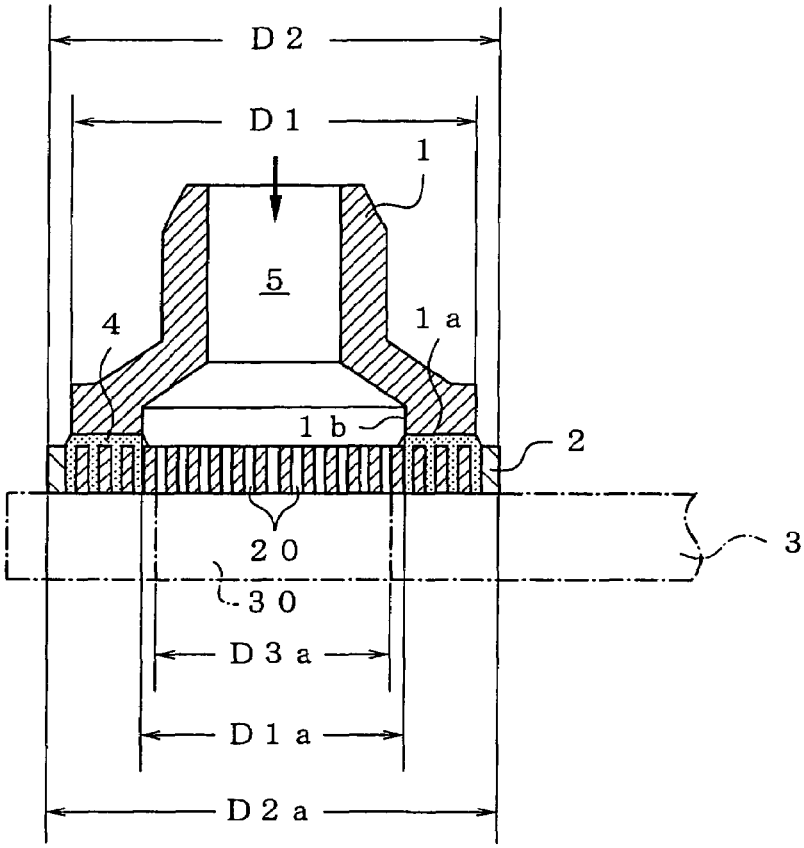
FIG. 7A is a schematic view of a bonding structure between a channel structure and a filter member, according to a second embodiment of the invention.
Figure 7B:
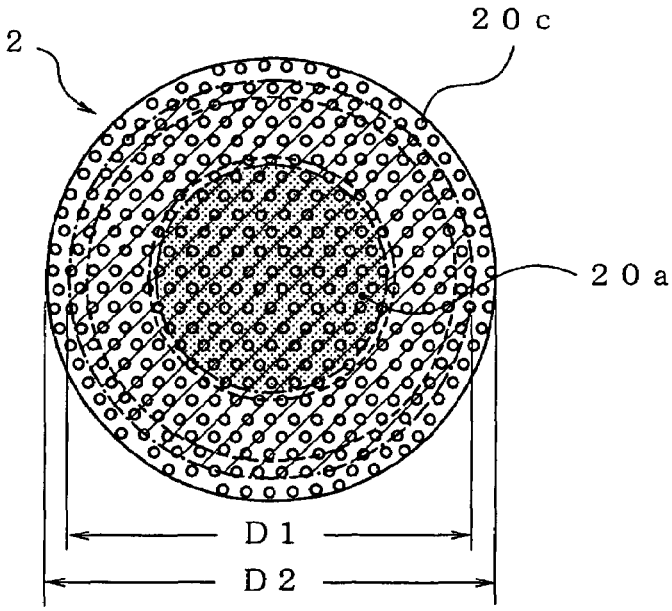
FIG. 7B is a plan view of the filter member.

FIGS. 7A and 7B show a bonding structure between a channel structure and a filter member, where the film member has filter holes formed across an entirety of the filter member, as described above. There will be described an inkjet printhead assembly including the bonding structure according to a second embodiment of the invention. FIG. 7A is a schematic view showing the bonding structure, and FIG. 7B is a plan view of the filter member. The elements or parts corresponding to those in the first embodiment will be denoted by the same reference numerals as used in the first embodiment and description thereof is omitted.

In the second embodiment, too, the outer diameter D2 of a filter member 2 is made larger than the outer diameter D1 of a channel structure 1 by a small amount, and filter holes 20 are formed over an entirety of the filter member 2. That is, a hole area 20*c* across which the filter holes 20 are formed coincides with an entire major surface of the filter member 2. This arrangement prevents, with reliability, an adhesive 4 from flowing onto an upper surface of a head unit 3. Since the filter holes 20 are formed across an entirety of an area opposed to a fixing surface 1*a* of the channel structure 1, most of a surplus of the adhesive 4 enters the filter holes 20, substantially without a possibility of the surplus adhesive flowing onto the head unit 3. In view of this, the second embodiment may be modified such that the outer diameter D2 of the filter member 2 and the outer diameter D1 of the channel structure 1 are substantially the same.

As described above, by employing electroforming as a method for producing the filter member 20, it is enabled to integrally form the filter member 2 to have the small filter holes having a same shape and a same diameter of about 10 to 15 μm in a thin sheet of nickel alloy having a thickness of about 5 to 20 μm, for instance.

According to this arrangement, a part of the filter holes of the filter member having a size suitable for use in an inkjet printer can be utilized for aiding bonding between the filter member and the channel structure.

FIG. 2 shows an example of filter holes 20 formed by electroforming. The filter holes 20 have a same diameter d which may be 13 μm, and are arranged at intervals L1 which may be 23 μm. More specifically, the filter holes 20 are arranged such that around each filter hole 20 are disposed six filter holes 20 equiangularly spaced from each other around the filter hole. In other words, the filter holes 20 are arranged to be aligned in rows in two directions which form an angle of 60°, and in the two directions the filter holes are spaced from an adjacent one by distances L1 and L2, respectively. L1 and L2 are identical and may be 23 μm. The shape of the filter holes 20 as seen from the upper side is not limited to a circle, but may be a polygon such as hexagon.

According to this arrangement where the filter member 2 is formed by electroforming to have the filter holes 20 across its entire area, all the filter holes 20 can be formed in the filter member 2 at once and in a same way. That is, the filter holes for filtering the ink, the filter holes formed in the fixing area only for aiding bonding with the channel structure, and the filter holes for accommodating the surplus of the adhesive so as to prevent the adhesive from undesirably flowing onto the head unit are all concurrently formable.

FIG. 3 shows a conventional bonding structure between a channel structure 1A and a filter member 2A. Filter holes 20A are formed in the filter member 2A only across a circular area corresponding to an upper end of an ink supply port having a diameter D3*b*. In the filter member 2A, there is not formed a filter hole in an area opposed to a fixing surface 1Aa of the channel structure 1A. That is, the circular area across which the filter holes 20A are formed has a diameter D2*b* which is smaller than a diameter D1*b* of a lower end of an ink supply channel defined inside the channel structure 1A. The diameter D2*b* of the area in which the filter holes 20 are formed is not smaller than the diameter D3*b* of the end of the ink supply port, and the ink flow is not inhibited at the bonding structure.

Where the flat fixing surface 1Aa of the channel structure 1A is simply bonded at a flat portion of the filter member 2A where the filter holes are not formed, the bonding structure is such that the filter member 2A made of metal and the channel structure 1A of resin, which are different in linear expansion coefficient, are bonded to each other. Hence, the bonded members may be separated from each other when an intense internal stress is generated at the interface of the two members by a change in the temperature of the environment or for other reasons. In addition, a part 4*a* of an adhesive 4 may flow into the filter holes upon bonding of the channel structure 1 to the filter member as shown in FIG. 3, partially closing the ink supply port having a diameter D3*b*, to disturb the supply of the ink.

Accordingly, in each of the embodiments of the invention the filter holes 20 are formed across a hole area extending beyond the area of the upper end of the ink supply port 30, and the channel structure 1 is bonded at a place which is in the hole area and on the outer side the area of the upper end of the ink supply port 30.

That is, the filter member 2 of the invention has the fixing area 20*b* on the radially outer side of the filtering area 20*a* which corresponds to the end of the ink supply port 30, and the channel structure 1 is bonded to the filter member 2 at the fixing area 20*b*. The filter holes 20 are formed not only in the filtering area but also in the fixing area 20*b*. At the fixing area

20*b*, the adhesive 4 flows into the filter holes 20 so that the channel structure 1 is bonded to the filter member 2 and accordingly fixed to the port portion.

Hence, a satisfactory bonding strength can be ensured even when the metallic filter member 2 and the resin channel structure 1 which are different in linear expansion coefficient are bonded to each other. Further, there is also obtained an effect that the adhesive 4 does not flow into the filtering area 20*a* corresponding to the ink supply port 30.

Even when the adhesive is applied in an excessive amount, the surplus of the adhesive flows into the filter holes 20 in the fixing area 20*b* or therearound, enhancing the bonding strength without disturbing the ink supply.

By employing electroforming as the method for producing the filter member 2, the identical filter holes are easily formed not only in the filtering area 20*a* but also in the fixing area 20*b* at which the channel structure 1 is bonded, and the filter member as a thin metal sheet in which the filter holes 20 of the desired shape and diameter are arranged is manufactured by a single step.

As described above, in the inkjet printhead assembly according to the invention, the filter holes of the filter member are formed even in the fixing area corresponding to the fixing surface of the channel structure, so that the adhesive is introduced into the filter holes in the fixing area so as to bond the channel structure to the filter member. Accordingly, the bonding strength between the filter member and the channel structure is enhanced. Further, even where the metallic filter member and the resin channel member having respective linear expansion coefficients are bonded to each other, the two members do not tend to separate from each other. Upon bonding of the channel structure to the filter member with the adhesive, the adhesive flows into the filter holes formed in the area of the filter member around the fixing area, without the surplus of the adhesive entering the filter holes in the filtering area corresponding to the ink supply port. Hence, the surplus of the adhesive does not increase the resistance in the ink channel to the ink flow, and accordingly does not disturb the supply of the ink.

In each of the above-described embodiments, the order of bonding of the three members, namely, the channel structure, the filter member, and the port portion of the head unit, is such that first the filter member is bonded to the port portion, and then the channel structure is bonded to the filter member. However, the order may be changed, for example, the three members may be bonded as follows: The channel structure and the filter member are first bonded to each other, and then the assembly of the channel structure and the filter member is bonded to the port portion.

In each of the above-described embodiments, the diameter of the ink supply port is smaller than the diameter of the end of the ink channel defined inside the channel structure. However, the diameter of the ink supply port may be slightly larger than that of the ink channel, in order to facilitate introduction of the surplus of the adhesive into the filter holes formed in the annular area around the filtering area.

Each of the above-described embodiments is application of the invention to the bonding structure between the metallic filter member and the resin channel structure. However, the invention may be applied to the bonding structure between a metallic filter member and a resin port portion of a head unit. In such a bonding structure, only the port portion may be made of resin, or alternatively an entire upper surface of the head unit may be covered with resin. In either case, the effects of the invention as described above can be obtained.

What is claimed is:

1. An inkjet printhead assembly comprising:

a channel structure defining inside thereof an ink supply channel connected to an ink supply source accommodating ink;

a filter member having:

a filtering area where a plurality of filter holes are formed through the thickness of the filter member; and a fixing area having a plurality of throughholes;

a head unit having a port portion where an ink supply port for introducing the ink supplied from the ink supply source via the filter holes is formed so that the head unit ejects droplets of the ink;

the fixing area of the filter member being located at an outer circumferential position with respect to the ink supply port;

the channel structure, the fixing area of the filter member, and the port portion of the head unit being bonded to one another with an adhesive; and a part of the adhesive being accommodated in the throughholes and connecting the channel structure and the port portion.

2. The inkjet printhead assembly according to claim 1, wherein an entirety of an area of an open end of the ink supply port on the side at which the filter member is bonded to the port portion is located within an area of an end of the ink supply channel on the side at which the channel structure is bonded to the filter member, as seen in a direction of superposing of the channel structure and the filter member, and wherein an outer circumference of the filter member is located on the outer side of, or substantially at the same position as, an outer circumference of the channel structure.

3. The inkjet printhead assembly according to claim 1, wherein in the fixing area the throughholes are formed across an inner area extending from a radial position corresponding to a circumference of the ink supply channel to at least a radial position corresponding to a substantially middle position in a width direction of an annular fixing surface at which the channel structure is bonded to the filter member.

4. The inkjet printhead assembly according to claim 3, wherein the filter holes are formed across an entire area of the filter member.

5. The inkjet printhead assembly according to claim 4, wherein the filter holes are formed in the same shape and diameter and at the same intervals, and a part of the filter holes constitute the throughholes.

6. The inkjet printhead assembly according to claim 1, wherein at least one of the channel structure and the port portion is made of a resin, and the filter member is formed of a sheet metal.

7. The inkjet printhead assembly according to claim 1, wherein the filter holes have a circular shape, the thickness of the filter member is about 5 to 20 μm, and the diameter of the filter holes is about 10 to 15 μm.

* * * * *